US006582198B2

(12) United States Patent
Darby et al.

(10) Patent No.: US 6,582,198 B2
(45) Date of Patent: Jun. 24, 2003

(54) CONTROL STRATEGY FOR A THERMALLY ACTIVATED DIVERTER VALVE USED IN A WASHING APPLIANCE

(75) Inventors: Adam John Darby, Auckland (NZ); Jonathan David Harwood, Auckland (NZ)

(73) Assignee: Fisher & Paykel Limited, Auckland (NZ)

( * ) Notice: Subject to any disclaimer, the term of this patent is extended or adjusted under 35 U.S.C. 154(b) by 0 days.

(21) Appl. No.: 09/974,505

(22) Filed: Oct. 10, 2001

(65) Prior Publication Data

US 2002/0046428 A1 Apr. 25, 2002

(30) Foreign Application Priority Data

Oct. 10, 2000 (NZ) ..... 507419

(51) Int. Cl.[7] ..... F04B 49/00

(52) U.S. Cl. ..... 417/12; 417/32; 417/36; 68/12.21

(58) Field of Search ..... 417/12, 36, 32, 417/26, 28; 68/12.21, 53, 203

(56) References Cited

U.S. PATENT DOCUMENTS 4,227,546 A 10/1980 Bergeson ..... 137/387
4,402,197 A * 9/1983 Groult et al. ..... 68/12.21
4,945,735 A * 8/1990 Tarrano et al. ..... 68/12.19
4,949,556 A * 8/1990 Knauss ..... 68/16
5,191,668 A * 3/1993 Euler et al. ..... 8/158
5,233,718 A * 8/1993 Hardaway et al. ..... 8/158
5,249,441 A * 10/1993 Pastryk et al. ..... 68/23.4
5,271,251 A * 12/1993 Kovich et al. ..... 68/171
6,189,171 B1 * 2/2001 Savkar et al. ..... 8/159
6,393,872 B2 * 5/2002 Whah et al. ..... 68/12.02

* cited by examiner

*Primary Examiner*—Charles G. Freay
*Assistant Examiner*—William H. Rodriguez
(74) *Attorney, Agent, or Firm*—Trexler, Bushnell, Giangiorgi, Blackstone & Marr, Ltd.

(57) ABSTRACT

A washing appliance having a thermally actuated diverter valve to allow for the diversion of water through the water holding receptacle of the washing appliance, where control means controls the turning on and off of an inlet valve and energizing of the thermally actuated diverter valve. A method of controlling a thermally activated valve in the cycle of the washing appliance is also disclosed. This method provides for the operation of a thermally actuated diverter valve during a recirculation wash phase in a washing appliance. The present invention allows for the thermally actuated diverter valve's "on time" life to be conserved, particularly in situations where the flow of water into the appliance is low, for example when the appliance is used in areas where water pressure is low, or when valves or pipes are blocked or obscured.

5 Claims, 7 Drawing Sheets

CONTROL STRATEGY FOR A THERMALLY ACTIVATED DIVERTER VALVE USED IN A WASHING APPLIANCE

BACKGROUND OF THE INVENTION

1. Field of the Invention

This invention relates to control strategies for thermally activated diverter valves when used in a washing appliance. In particular, this invention relates to methods of switching a thermally actuated valve during operation of a recirculation cycle in a laundry washing appliance.

2. Summary of the Prior Art

Currently, many washing appliances use as a means of introducing or diverting water to the water receptacle of the appliance a thermally activated valve which is turned on when electricity is supplied to its electrical contacts, thereby heating the wax within the actuator and operating the switching of the valve from a first position (closed) to a second position (open). Usually, during the recirculation phase of a wash cycle the valve diverts water from the water receptacle and through a pipe to be recirculated back into the water receptacle. At the start of a wash cycle, the water receptacle is filled and the valve is energised. After some delay due to thermal actuation the valve is fully opened and allows water to be recirculated through the bowl. When the valve is closed and a pump turned on, the water within the receptacle is pumped through the valve to the drain.

Usually, once the thermally activated valve is switched on it takes a minute or so before it is fully activated and in an open position. Once activated and after the washing appliance's water receptacle has been filled, by way of an inlet valve, to a predetermined level, the recirculation phase of the wash cycle starts and water is pumped from the receptacle through the valve and directed back into the receptacle. The time taken for the receptacle to fill with water to the predetermined level usually corresponds to the time taken for the valve to warm up and be activated. Therefore, the valve is activated at approximately the same time as the washing appliance is ready to start the recirculation phase of the wash cycle.

In areas where there is a low water pressure and therefore a low flow rate the time generally taken for the bowl to fill with water to the predetermined level required for the recirculation phase may be as long as, for example, 10 minutes. Therefore in low water pressure areas, the valve is activated and is open after approximately one minute and is running hot. As valves of this type have a finite 'on time' life then the life of the valve is being shortened, as during a long fill cycle the valve is unnecessarily on.

There may be other situations that also result in a low flow rate of water into the appliance. Some examples are when valves or pipes are blocked. Therefore in all situations where the flow rate is low the valves life is being shortened.

SUMMARY OF THE INVENTION

It is therefore an object of the present invention to provide a control strategy for a thermally activated diverter valve when used with a washing appliance which will go at least some way to overcoming the abovementioned disadvantages or will at least provide the industry with a useful choice.

Accordingly, in a first aspect the invention consists in a washing appliance which has a recirculating wash cycle comprising or including:

(a) a water holding receptacle,
(b) an inlet valve that admits water to fill said water holding receptacle to a predetermined level,
(c) a pump, which pumps water from the receptacle,
(d) a thermally actuated diverter valve connected to the outlet of said pump, which when energised opens to divert water from the pump back into the receptacle and when not actuated allows water to be discharged from the receptacle, and
(e) control means, which energises said diverter valve at or near the time taken for water in said receptacle to reach said predetermined level.

In a second aspect the invention consists in a method of controlling a thermally actuated diverter valve during a recirculation cycle of a washing appliance, wherein said washing appliance comprises or includes a water holding receptacle, an inlet valve, a pump connected to said diverter valve, and control means which stores a program which causes the control means to:

(a) open said inlet valve and fill said receptacle with water to a predetermined level,
(b) close said inlet valve,
(c) energise said thermally activated diverter valve at or near the time taken to reach said predetermined level,
(d) activate said pump, which pumps water from the receptacle through said diverter valve and back into said receptacle, and
(e) de-energise said diverter valve at the end of said recirculation cycle to allow for water to be discharged from said receptacle.

In a third aspect the invention consists in a method of controlling a thermally activated diverter valve during the recirculation cycle of a washing appliance, wherein said washing appliance comprises or includes a water holding receptacle, an inlet valve, a pump, and control means which stores a program and monitors a low flow rate flag, said program causing said control means to control a first wash phase and subsequent wash phases, said method including the steps of:

(a) said control means monitoring said low flow rate flag, and either commencing said washing cycle by switching on said inlet valve and filling said receptacle to a predetermined water level if said flag is set, or
energising on said diverter valve and opening said at least one inlet valve, then commencing said washing cycle if said flag is not set,
(b) said control means monitoring said water level within said receptacle, and either
clearing said flag if said predetermined water level has been reached and the time taken to fill said receptacle to said predetermined water level is less than a minimum time, then switching on said diverter valve if said diverter valve is not already on and commencing said first wash phase, or
leaving said flag unchanged if said predetermined water level has been reached and said time taken to fill said receptacle to said predetermined water level is greater than said minimum time, then energising said diverter valve if said diverter valve is not already energised and commencing the recirculation wash phase, or
leaving said flag unchanged if said predetermined water level has not been reached and said time taken to fill said receptacle to said level has taken less than a maximum time then continuing with step b), or
setting said flag if said predetermined water level has not been reached and said time taken to fill said receptacle is greater than said maximum time and said flag is not already set, then de-energising said diverter valve and continuing with step b), or leaving said flag if said predetermined water level has not been reached and said time taken to fill said receptacle is greater than said maximum time and said flag is already set, then continuing with step b) until said receptacle is filled with water to said predetermined water level, (c) starting the first wash phase of said wash cycle and de-energising said diverter valve during said first wash cycle, and (d) continuing with said subsequent wash phases until said wash cycle is completed.

In a fourth aspect the invention consists in a method of controlling a thermally activated diverter valve during the cycle of a washing appliance, wherein said washing appliance comprises or includes a water holding receptacle, an inlet valve, a pump, and control means which stores a program and causes the control means to:

open said inlet valve and energise said diverter valve and fill said receptacle with water to a predetermined water level, monitor the time taken to fill said receptacle to said predetermined water level, and commence said wash cycle, complete said wash cycle, wherein in a subsequent wash cycle before commencement of said subsequent wash cycle the energising of said diverter valve is delayed to said monitored time taken to fill said receptacle less a thermal activation time, and said subsequent wash cycle is commenced once said predetermined water level is reached.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the present invention will now be described with reference to the accompanying drawings in which.

DETAILED DESCRIPTION OF THE PREFERRED EMBODIMENTS

Figure 1:
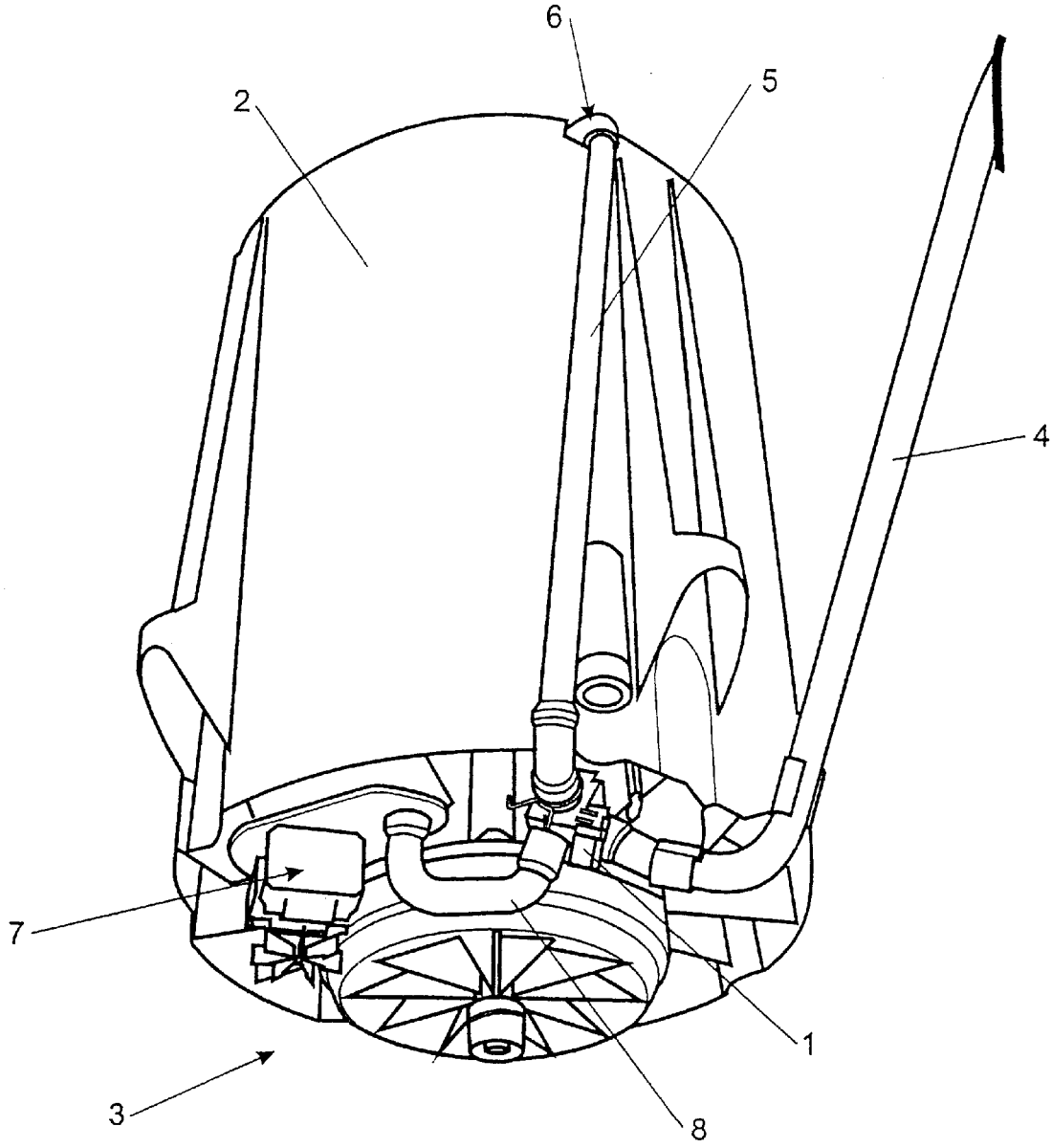
FIG. 1 is a perspective view of the bowl and external pipe work or the apparatus of the present invention.
Figure 1A:
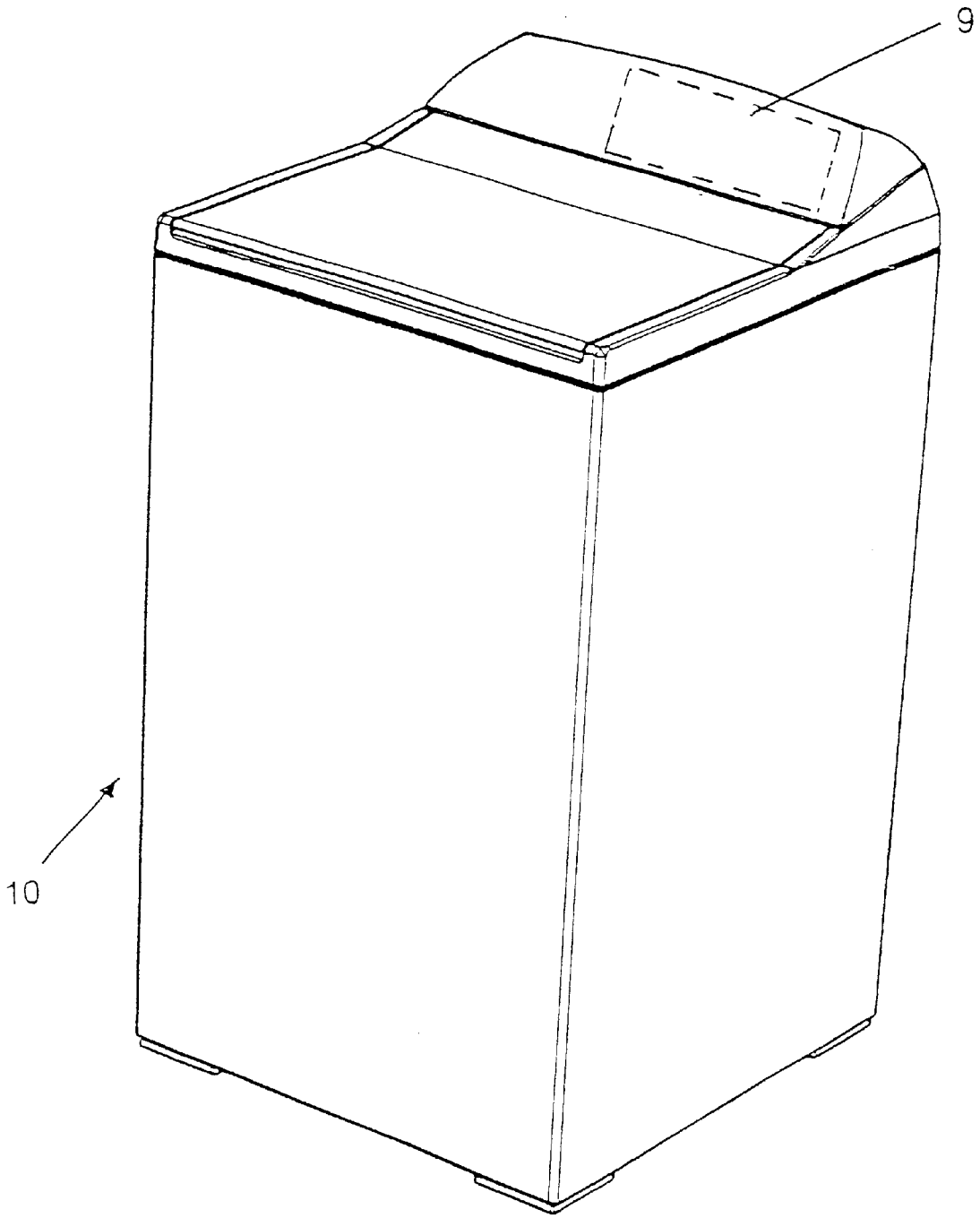
FIG. 1A is a perspective view of a washing appliance.

The present invention, in the preferred embodiment, provides a control strategy for the operation of a thermally activated valve during the initial phases in a laundry washing appliance 10, as shown in FIG. 1A. This control strategy allows for the conversation of the valve's 'on time' life particularly in situations where a laundly washing appliance the flow of water into the appliance is low, for example when the appliance is used in areas where water pressure is low, or when valves or pipes are blocked or obscured.

Operation of the Valve

A thermal actuator that opens and closes the valve consists of a positive temperature co-efficient (PTC) heater, a wax actuator, piston and spring that work together to switch the valve from its position to its open position.

When the PTC heater is energised by providing a current over electrical contact connected to the PTC heater, the PTC heater raises the temperature of the wax casing, the wax contained in the casing expands and forces a piston to move outwards axially transmitting a thrust to move the valve into the open position.

When current is no longer supplied to the PTC heater the temperature of the casing drops and the wax cools and returns to its original state. During cooling of the wax the spring within the casing forces the piston to move back to its original position thereby returning the valve to its closed position.

The PTC heater is preferably connected and energised, by way of electrical contacts and wires, to the electronics controller (control means 9) contained within the washing appliance 10 as shown in FIG. 1A.

Control of the Thermally Activated Diverter Valve

The present invention controls the time at which the thermal actuator is energised. In the preferred form of the present invention this is done by monitoring the time taken for the bowl of the washing appliance to fill to a predetermined level. This level preferably being the level as used in the recirculating phase of a laundry washing appliance cycle. This water level is preferably approximately 50 mm from the bottom of the bowl or approximately 25 liters depending on the load size and absorbency of the items within the washing appliance bowl, although the fill may continue until the items are fully saturated with water.

Irrespective of the pressure of the water, upon installation of the washing appliance in a household, during the first wash of the washing appliance the thermally activated valve ("diverter valve") is switched on when the inlet valve is switched on at the start of the fill phase and the washing bowl starts to fill with water.

Figure 2:
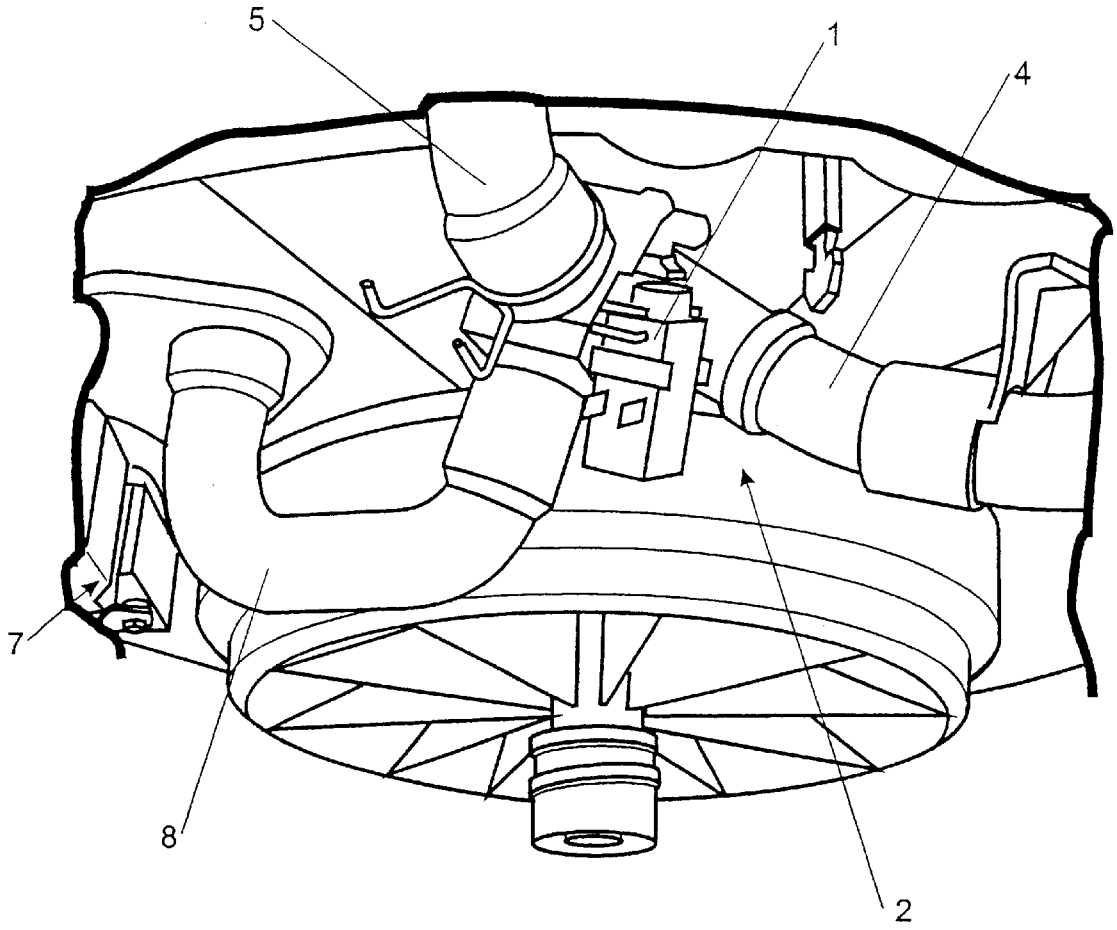
FIG. 2 is a close-up perspective view of the valve of the present invention.

Referring to FIGS. 1 and 2, in the preferred form of the present invention, the thermal valve 1 is external to the bowl 2 of the laundry washing appliance 3. The drain hose 4 is connected to one outlet of the diverter valve 1 and the recirculation hose 5 is connected to the other outlet of the diverter valve 1 wherein the other end of the recirculation hose 5 empties into the bowl 2 at the top end 6 of the laundry washing appliance 3. When the diverter valve is in the closed position and the pump 7 is activated, water is drained from the bowl 2, through a connecting pipe 8, through the valve 1 and out through the drain pipe 4. Alternatively, when the valve 1 is in the open position and when the pump 7 is activated, water is pumped through the connector pipe 8 and moves trough the valve 1 up through the recirculation pipe 5 and back into the bowl 2 of the washing appliance 3.

Figure 3:
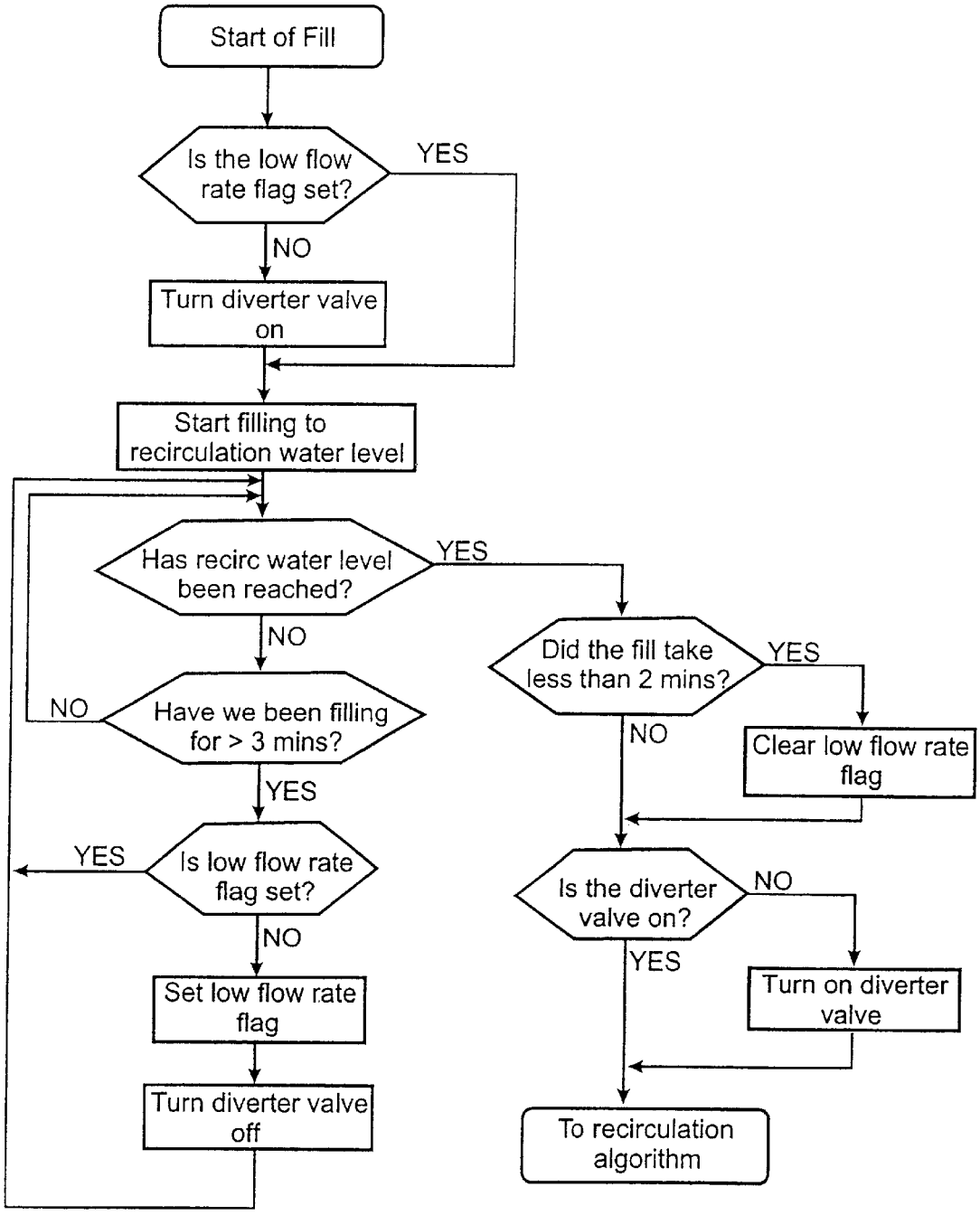
FIG. 3 is a flow diagram according to the present invention showing the logic control for operation of the initial phases in the washing cycle of a laundry washing appliance.

Referring now to FIG. 3, the algorithm used in the control electronics (control means 9), preferably a micro controller or other appropriate programmable logic, to maximise the life of a thermally activated valve for low flow rate installations is shown. Basically if the flow rate through the inlet valve is below a certain level the diverter valve is not switched on until the fill is completed. As the valve takes approximately 1 minute to heat up, and the fill takes, for example, 10 minutes, the valve life will be consumed quickly if the valve is on during the whole fill phase. The extra minute added to the full washing cycle compared to the low water pressure fill time is small. Conversely, if the flow rate is high, the cycle time must be kept as short as possible, so the diverter valve is turned on when the fill starts. If the washing appliance is moved from a high water pressure location to a low water pressure location, or vice-versa, the washing appliance automatically compensates for this on the first wash cycle commenced at the new location.

The algorithm as shown in FIG. 3 will now be described. At the start of the fill at the beginning of the wash cycle of the washing appliance the electronics controlling the fill cycle, interrogates a low rate flag. If the flag is not set, the diverter valve is activated. Alternatively, if the flag is set then the diverter valve is not activated. Next, the filling of the bowl ready for the recirculation phase is commenced. The control electronics monitor the time taken to reach the predetermined recirculation water level in the bowl by interrogating a pressure sensor located within the electronics, where the pressure sensor detects the pressure within a sealed tube located on the side of the bowl, which is connected to an air bell at the bottom of the bowl, once this level is reached the control electronics determine whether the fill took longer than a maximum time or not. If the fill took less than a minimum time the control electronics clear the low flow rate flag and if the diverter valve is not on it is activated. Once the valve has been activated and has been allowed to switch on, the time taken to fully open being approximately one minute, the recirculation phase is commenced and the washing appliance continues with the wash cycle comprising any number of wash, rinse and spin cycles as determined by the user and controlled by the control electronics. Note, in the preferred form the minimum time referred to above is two minutes and the maximum time is three minutes.

Alternatively, if the predetermined water level has not been reached when the control electronics interrogates the water level sensor and if the fill cycle has taken longer than the maximum time then the low flow rate flag is set if not already and the diverter valve is turned off. Again, once the predetermined water level has been reached the control electronics activates the diverter valve.

Therefore, the controlling of the switching of the thermal valve preserves the life of the valve by reducing the unnecessary run time of the valve.

It is envisaged that an algorithm will be included where in the second wash cycle, the diverter valve will be switched on at a time taken to fill the bowl with water to the predetermined level (recirculation level) in the previous wash cycle minus the valve activation time. Therefore, when the bowl has filled with water to the predetermined level, the valve has already warmed up, is open and allows water to be recirculated. In this situation the control electronics will monitor the time taken to fill the bowl to the recirculation level during a sample of previous wash cycles. Therefore, in the first cycle the diverter valve will be activated at the start of the fill phase, but in the second cycle, the control electronics delay the activation of the diverter valve to ensure it is open at the end of the recirculation fill cycle, further ensuring the valve is not unnecessarily on. For example, the control electronics may be programmed to monitor a sample of previous washes and stores the time taken to fill to the recirculation level, then calculate an "average fill time". The control electronics will then energise the valve at approximately a minute (equivalent to the valve activation time) before the completion of the average fill time. Therefore, the wash cycle is not delayed or extended by the valve switching and the valves life is preserved.

Figure 4:
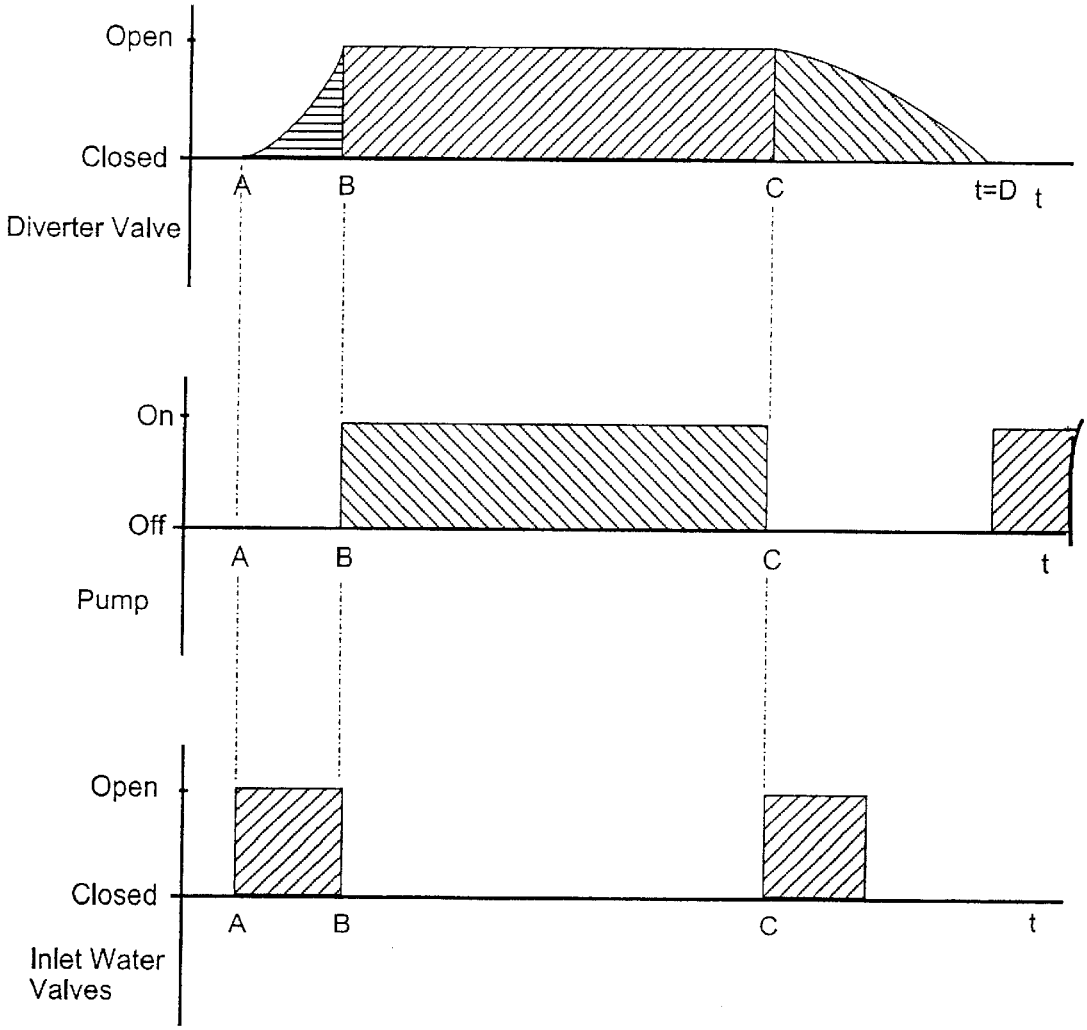
FIG. 4 shows a set of timing diagrams where a laundry washing appliance is operating in a high water pressure area and the low flow rate flag is not set.

Referring now to FIG. 4, timing diagrams of the on and off, and open and closed sequences of the diverter valve 1, pump 7 and inlet water valve(s) are shown when the washing appliance is being operated in a high water pressure area. When the washing appliance is tuned on at time A the inlet water valves are opened and the bowl starts to fill with water and/or detergent. The diverter valve is activated when the inlet water valve is opened at the beginning of the washing cycle. Once the thermal actuator has heated up the piston of the actuator has caused the valve to be fully opened. The inlet valve is closed as the predetermined water level as required for the recirculation phase has been reached. Therefore, at time B the diverter valve is fully open, the pump has switched on and is recirculating water through the bowl and recirculation pipe. During the recirculation cycle the diverter valve remains open, until the pump is switched off, at which point the diverter valve is de-energised. As can be seen, at time C the diverter valve will slowly close until at time D the diverter valve has completely closed. During closing of the diverter valve the washing cycle continues in the wash phase. For illustration, assuming the wash cycle is completed at the time D when the diverter valve is completely closed, the pump is turned on and water is pumped from the bowl, exiting through the connecting pipe 7, through the diverter valve and to the drain pipe so, the diverter valve is not required to close immediately as after the recirculation phase because the washing cycle moves into a wash phase, which may last between ten and twelve minutes depending on the user's requirements and predetermined settings, and allows plenty of time for the wax in the actuator to cool and the diverter valve to close. This closing of the valve usually takes approximately three to four minutes to complete.

Figure 5:
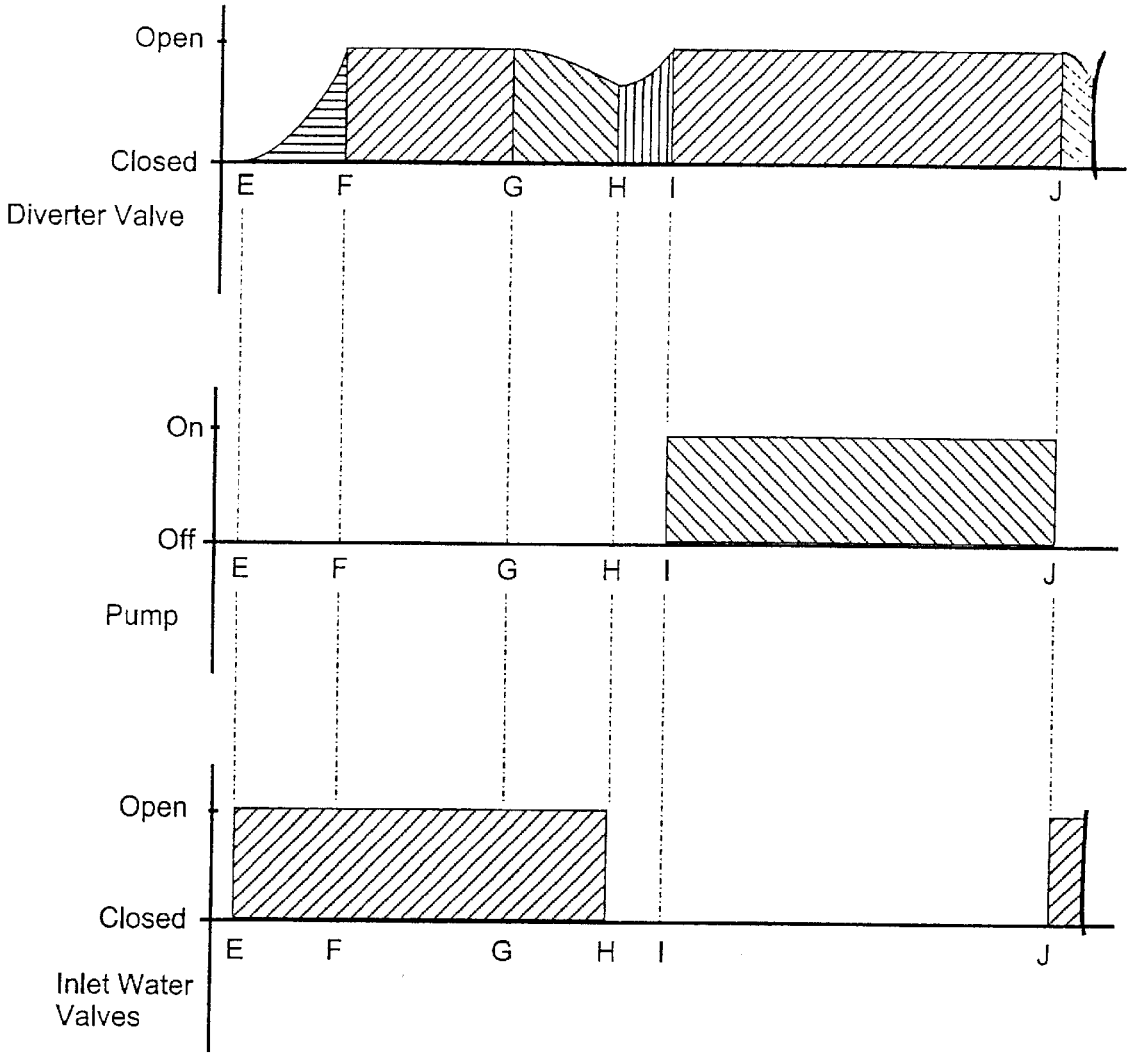
FIG. 5 shows a set of timing diagrams where a laundry washing appliance is operating in a low water pressure area and the low flow rate flag is not set.

FIG. 5 shows a timing diagram of the on and off, and open and closed sequences of the diverter valve, pump and inlet water valves in a low flow rate situation where a washing appliance is being used in a low water pressure area. At the start of the wash cycle (time E) the inlet water valve and diverter valve are activated and the thermal actuator heats up over time and the piston of the actuator slowly opens the diverter valve until time F when the valve is fully open. During time period E to G the bowl is filled with water fed from the inlet valve. At time G the control electronics, controlling the switching of the valves, senses that the recirculation level has not been reached and switches the diverter valve off. As the actuator relies on thermal conductivity, it closes the valve at a slower rate than the opening of the valve (time period E to F). At time H when the recirculation level is reached as sensed by the control electronics, the inlet water valve is switched off by the control electronic. Again, the diverter valve is activated and heats up over the shortened tie H to I. During his time period neither the bowl is filling with water nor has the recirculation phase started. Therefore, there is a delay in the wash cycle. At time I when the diverter valve is fully open the pump is activated and the recirculation phase commences. Once the recirculation cycle is complete, at time J, the diverter valve is de-energised, and the wash phase of the washing cycle is commenced.

Figure 6:
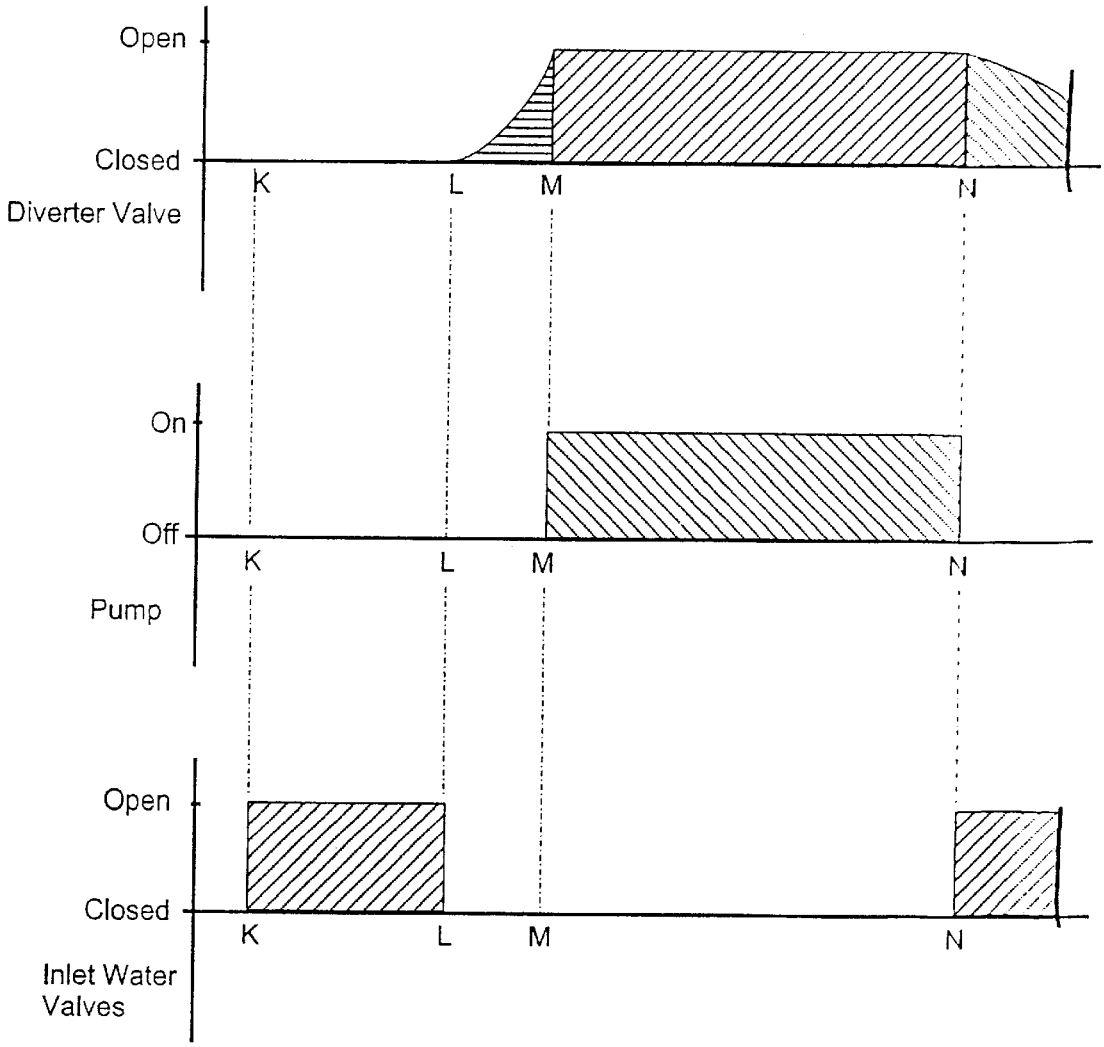
FIG. 6 shows a set timing diagrams where a laundry washing appliance is operating in a low water pressure area and the low flow rate flag is set.

FIG. 6 shows a further set of timing diagrams showing the on and off and open and closed positions of the diverter valve, pump and inlet water valves where the low flow rate flag has been set. The low flow rate flag is set once the control electronics, normally a micro controller, have sensed that the washing appliance is being operated under a low water pressure situation due to the long time taken to fill to the recirculation level. At time K the appliance is switched on and the wash cycle is commenced, as described above. When the recirculation level is reached at time L, the thermal valve is switched on and heats up, taking approximately 1 minute until it is in the fully open position. At time L the diverter valve is open and the pump is switched on. The diverter valve and pump remain open and on respectively, until the recirculation phase is completed at time N. The diverter valve is then de-energised and the inlet water valves are opened so that the bowl can be filled to the predetermined level as required by the wash cycle. As the wax in the thermal actuator cools the valve moves into the closed position at some point (not shown) during the wash cycle. The appliance then completes the rest of the cycle by completing a predetermined number of spin, drain and rinse cycles.

As shown in FIGS. 5 and 6 the control strategy of the present invention provides for the preservation of the diverter valve and thermal actuator life by either delaying the turn on time of the diverter valve or turning the valve off if the fill phase takes longer than 3 minutes, the diverter valve being turned on again only when the fill is completed.

It is also envisaged to use a diverter valve to recirculate water during the wash or rinse phases of the washing cycle. Here the water in the bowl would be recirculated and diverted through a heater or detergent container to maintain water temperatures or provide higher detergent levels in the water. The same type of method as described above would be used to implement recirculation during these cycles and would provide improvements in rinsing without having to add any extra components to the washing appliance.

Furthermore, the diverter valve 'on time' life may also be controlled using the same logic and control as described above.

Although in the preferred embodiment of the present invention, the diverter valve has an active state that prevents recirculation and an inactive sate that allows for draining of water from the bowl of the washing appliance it is envisaged that the diverter valve may have opposing states. That is, an inactive state that allows recalculation and an active state in which allows water from the bowl to be pumped to the drain. Here the control electronics would control the time in which the valve is activated, this time would preferably be at a suitable time during the wash phase prior to the draining phase. Also, the control electronics may allow for the valve to be turned on at a time approximately one minute, that is, the valve turn on time, before draining is to commence.

What is claimed is:

1. A washing appliance, which has a recirculating wash cycle, comprising or including:

(a) a water holding receptacle, (b) an inlet valve that admits water to fill said water holding receptacle to a predetermined level, (c) a pump, which pumps water from the receptacle, (d) a thermally actuated diverter valve connected to the outlet of said pump, which when energised opens to divert water from the pump back into the receptacle and when not actuated allows water to be discharged from the receptacle, and (e) control means, which energises said diverter valve at or near the time taken for water in said receptacle to reach said predetermined level.

2. A method of controlling a thermally actuated diverter valve during a recirculation cycle of a washing appliance, wherein said washing appliance comprises or includes a water holding receptacle, a inlet valve, a pump connected to said diverter valve, and control means which stores a program which causes the control means to:

(a) open said inlet valve and fill said receptacle with water to a predetermined level, (b) close said inlet valve, (c) energise said thermally activated diverter valve at or near the time taken for water in said receptacle to reach said predetermined level, (d) activate said pump, which pumps water from the receptacle through said diverter valve and back into said receptacle, and (e) de-energise said diverter valve at the end of said recirculation cycle to allow for water to be discharged from said receptacle.

3. A method of controlling a thermally activated diverter valve during the recirculation cycle of a washing appliance, wherein said washing appliance comprises or includes a water holding receptacle, an inlet valve, a pump, and control means which stores a program and monitors a low flow rate flag, said program causing said control means to control a first wash phase and subsequent wash phases, said method including the steps of:

(a) said control means monitoring said low flow rate flag, and either commencing said washing cycle by switching on said inlet valve and filling said receptacle to a predetermined water level if said flag is set, or
energising on said diverter valve and opening said at least one inlet valve, then commencing said washing cycle if said flag is not set, (b) said control means monitoring said water level within said receptacle, and either
clearing said flag if said predetermined water level has been reached and the time taken to fill said receptacle to said predetermined water level is less than a minimum time, then switching on said diverter valve if said diverter valve is not already on and commencing said first wash phase, or
leaving said flag unchanged if said predetermined water level has been reached and said time taken to fill said receptacle to said predetermined water level is greater than said minimum time, then energising said diverter valve if said diverter valve is not already energised and commencing the recirculation wash phase, or
leaving said flag unchanged if said predetermined water level has not been reached and said time taken to fill said receptacle to said level has taken less than a maximum time then continuing with step b), or
setting said flag if said predetermined water level has not been reached and said time taken to fill said receptacle is greater than said maximum time and said flag is not already set, then de-energising said diverter valve and continuing with step b), or
leaving said flag if said predetermined water level has not been reached and said time taken to fill said receptacle is greater than said maximum time and said flag is already set, then continuing with step b)

until said receptacle is filled with water to said predetermined water level, (c) starting the first wash phase of said wash cycle and de-energising said diverter valve during said first wash cycle, and (d) continuing with said subsequent wash phases until said wash cycle is completed.

4. A method of controlling a thermally activated diverter valve during the cycle of a washing appliance, wherein said washing appliance comprises or includes a water holding receptacle, an inlet valve, a pump, and control means which stores a program and causes the control means to:

open said inlet valve and energise said diverter valve and fill said receptacle with water to a predetermined water level, monitor the time taken to fill said receptacle to said predetermined water level, and commence said wash cycle, complete said wash cycle, wherein in a subsequent wash cycle before commencement of said subsequent wash cycle the energising of said diverter valve is delayed to said monitored time taken to fill said receptacle less a thermal activation time, and said subsequent wash cycle is commenced once said predetermined water level is reached.

5. A method of controlling a thermally activated diverter valve during the cycle of a washing appliance according to claim 4 wherein said thermal activation time is the time taken for said diverter valve to be fully opened.

* * * * *